US012410921B2

(12) United States Patent
Mercer et al.

(10) Patent No.: US 12,410,921 B2
(45) Date of Patent: Sep. 9, 2025

(54) AIR HANDLER

(71) Applicant: Rheem Manufacturing Company, Atlanta, GA (US)

(72) Inventors: Kevin Mercer, Danville, IN (US); Ammar Khuzeima Sakarwala, Dallas, TX (US)

(73) Assignee: Rheem Manufacturing Company, Atlanta, GA (US)

( * ) Notice: Subject to any disclaimer, the term of this patent is extended or adjusted under 35 U.S.C. 154(b) by 260 days.

(21) Appl. No.: 18/312,294

(22) Filed: May 4, 2023

(65) Prior Publication Data

US 2023/0358419 A1 Nov. 9, 2023

Related U.S. Application Data

(60) Provisional application No. 63/364,144, filed on May 4, 2022.

(51) Int. Cl.
*F24F 1/0067* (2019.01)

(52) U.S. Cl.
CPC ..... *F24F 1/0067* (2019.02)

(58) Field of Classification Search
CPC ..... F24F 1/0067; F24F 13/222; F24F 13/30; F24F 13/20
USPC ..... 165/172
See application file for complete search history.

(56) References Cited

U.S. PATENT DOCUMENTS

2012/0140724 A1* 6/2012 Sipola ..... H04L 1/1607 370/329
2020/0025395 A1* 1/2020 Zhou ..... F24F 13/20
2020/0378694 A1* 12/2020 Chehade ..... F28F 9/266

* cited by examiner

*Primary Examiner* — Steve S Tanenbaum
(74) *Attorney, Agent, or Firm* — Eversheds Sutherland (US) LLP

(57) ABSTRACT

The present disclosure provides an air handler including a V-shaped round tube plate fin evaporator coil disposed within a cabinet, a first coil extension coupled to a first tube sheet at a first arm of the evaporator coil, a second coil extension coupled to a second tube sheet at a second arm of the evaporator coil, and a door disposed on a front portion of the cabinet to provide access to the evaporator coil. Each of the first coil extension and the second coil extension extends along a transverse direction of the evaporator coil. The first coil extension, the second coil extension, and the door are together configured to achieve an air-tight seal.

17 Claims, 11 Drawing Sheets

AIR HANDLER

CROSS-REFERENCE TO RELATED APPLICATION

This application claims the benefit of U.S. application Ser. No. 63/364,144, filed May 4, 2022, the entirety of which is hereby incorporated by reference.

TECHNICAL FIELD

The present disclosure relates, in general, to heat exchangers and, more specifically, relates to removable fixtures for an evaporator coil.

BACKGROUND

Known air handlers employ delta plates on both sides of an evaporator coil, such as a V-coil, to prevent air from bypassing the evaporator coil. In cases where return air or air from surrounding is forced through the evaporator coil for long period of time, an upstream portion of the evaporator coil is subjected to deposition of dust. Presence of the delta plates prevents access to the upstream portion of the evaporator coil and requires removal of the evaporator coil from a cabinet of the air handler to perform cleaning and maintenance activities. As such, presence of the delta plates prolongs the maintenance activity besides increasing an overall weight and cost of the air handler.

SUMMARY

According to an aspect of the present disclosure, an air handler is disclosed. The air handler includes a cabinet, a V-shaped round tube plate fin evaporator coil disposed within the cabinet, a first coil extension coupled to a first tube sheet at a first arm of the V-shaped round tube plate fin evaporator coil, and a second coil extension coupled to a second tube sheet at a second arm of the V-shaped round tube plate fin evaporator coil. Each of the first coil extension and the second coil extension extends along a transverse direction of the V-shaped round tube plate fin evaporator coil. The air handler also includes a door disposed on a front portion of the cabinet to provide access to the V-shaped round tube plate fin evaporator coil. In such an arrangement, the first coil extension, the second coil extension, and the door are together configured to achieve an air-tight seal.

In an embodiment, the first coil extension is removably coupled to the first tube sheet and the secondly coil extension is removably coupled to the second tube sheet.

In an embodiment, the door is detachably coupled to the cabinet via tooled fasteners.

In an embodiment, the air handler further includes a first sealing member attached to a first peripheral surface of the first coil extension, and a second sealing member attached to a second peripheral surface of the second coil extension. The first sealing member and the second sealing member are configured to achieve the air-tight seal with an inner surface of the door.

In an embodiment, each of the first sealing member and the second sealing member of the air handler includes a compressive material.

In some embodiments, each of the first sealing member and the second sealing member is one of compressible closed cell foam, silicone, latex rubber, butyl rubber, or a resin-based sealant.

In some embodiments, a thickness of each of the first sealing member and the second sealing member is in a range of about 0.125 inch to about 0.75 inch.

In an embodiment, each of the first coil extension and the second coil extension includes a flat longitudinal surface configured to direct condensate towards a drain pan of the V-shaped round tube plate fin evaporator coil.

In an embodiment, the air handler further includes a first insulation strip attached to a bottom surface of the first coil extension and a second insulation strip attached to a bottom surface of the second coil extension. Each of the first insulation strip and the second insulation is configured to prevent dripping of condensate from corresponding bottom surfaces of the first coil extension and the second coil extension.

In some embodiments, each of the first insulation strip and the second insulation strip includes foam.

In some embodiments, a thickness of each of the first insulation strip and the second insulation strip is in a range of about $1/16^{th}$ inch to about $1/8^{th}$ inch.

In an embodiment, the first tube sheet defines a first slit and the second tube sheet defines a second slit. Further, the first coil extension includes a first tab to engage with the first slit, and the second coil extension includes a second tab to engage with the second slit.

In an embodiment, the first tube sheet includes a first flange, and the second tube sheet includes a second flange. Further, the first coil extension defines a first locating hole to engage with the first flange, and the second coil extension defines a second locating hole to engage with the second flange.

In another embodiment, each of the first coil extension and the second coil extension includes a root member to engage with a drain pan of the V-shaped round tube plate fin evaporator coil.

In some embodiments, each of the first coil extension and the second coil extension is made of one of aluminum, steel, or galvanized steel.

In some embodiments, a length of each of the first coil extension and the second coil extension is in a range of about 18 inches to about 40 inches.

In some embodiments, the air handler further includes a third coil extension coupled to a rear portion of a first arm of the V-shaped round tube plate fin evaporator coil and a fourth coil extension coupled to a rear portion of a second arm of the V-shaped round tube plate fin evaporator coil. Each of the third coil extension and the fourth coil extension extends along the transverse direction of the V-shaped round tube plate fin evaporator coil. The third coil extension, the fourth coil extension, and a rear panel of the cabinet are together configured to achieve an air-tight seal.

According another aspect of the present disclosure, a method of assembling a V-shaped round tube plate fin evaporator coil of an air handler is disclosed. The method includes disposing a first tube sheet at a first arm of the V-shaped round tube plate fin evaporator coil; disposing a second tube sheet at a second arm of the V-shaped round tube plate fin evaporator coil; engaging a first tab of a first coil extension with a first slit defined in the first tube sheet; engaging a second tab of a second coil extension with a second slit defined in the second tube sheet; and locking the first coil extension and the second coil extension in position based on the engagement of the first tab with the first slit and the second tab with the second slit.

In an embodiment, the method further includes aligning a first locating hole defined in the first coil extension with a first flange of the first tube sheet; aligning a second locating hole defined in the second coil extension with a second flange of the second tube sheet; and engaging the first flange with the first locating hole and the second flange with the second locating hole.

In some embodiments, the method includes attaching a first sealing member to a first peripheral surface of the first coil extension and a second sealing member to a second peripheral surface of the second coil extension.

These and other aspects and features of non-limiting embodiments of the present disclosure will become apparent to those skilled in the art upon review of the following description of specific non-limiting embodiments of the disclosure in conjunction with the accompanying drawings.

BRIEF DESCRIPTION OF THE DRAWINGS

A better understanding of embodiments of the present disclosure (including alternatives and/or variations thereof) may be obtained with reference to the detailed description of the embodiments along with the following drawings, in which.

DETAILED DESCRIPTION

Figure 1:
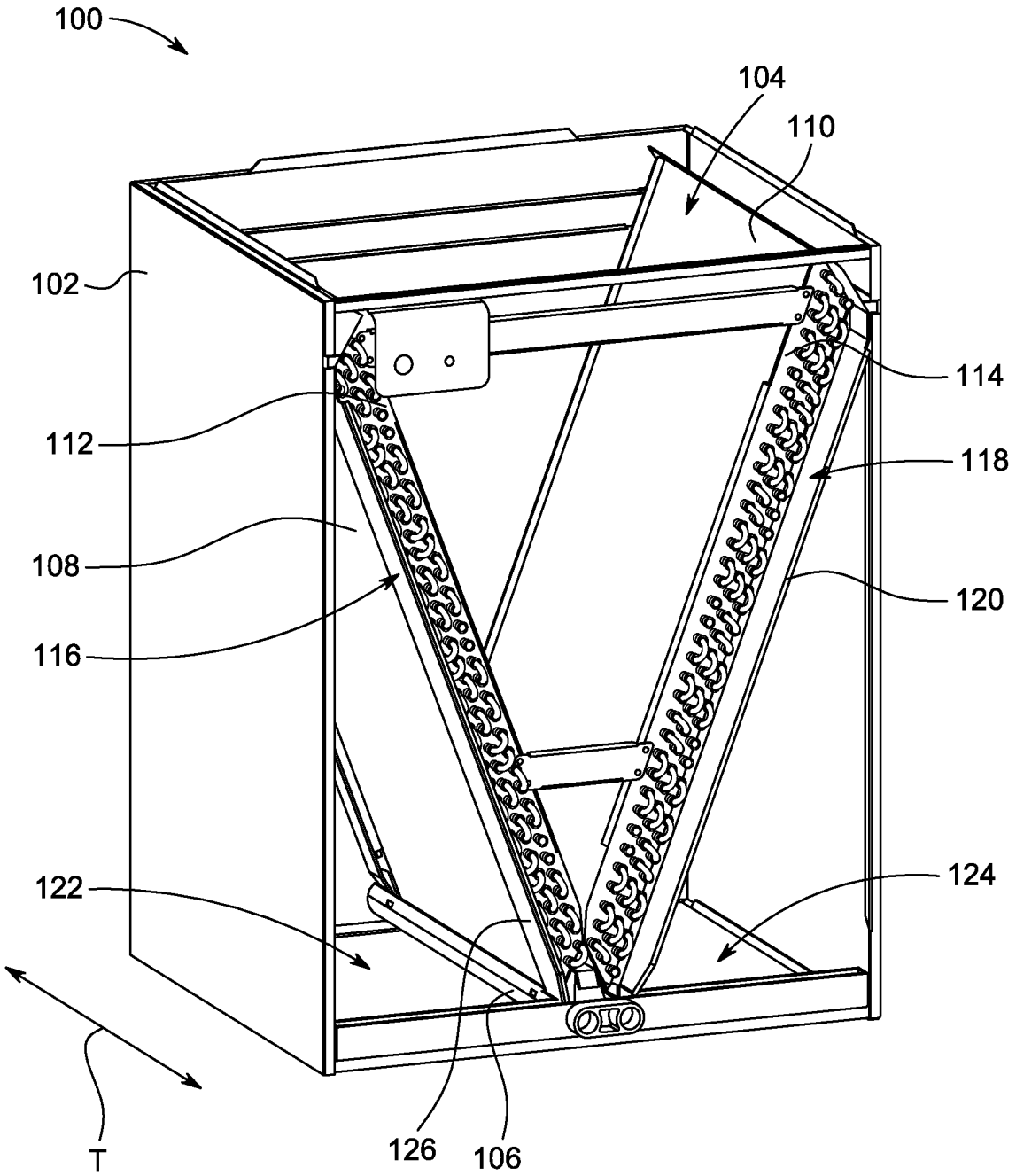
FIG. 1 is a perspective view of an air handler, according to an embodiment of the present disclosure.

Reference will now be made in detail to specific embodiments or features, examples of which are illustrated in the accompanying drawings. Wherever possible, corresponding, or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Although various aspects of the disclosed technology are explained in detail herein, it is to be understood that other aspects of the disclosed technology are contemplated. Accordingly, it is not intended that the disclosed technology is limited in its scope to the details of construction and arrangement of components expressly set forth in the following description or illustrated in the drawings. The disclosed technology can be implemented and practiced or carried out in various ways. In particular, the presently disclosed subject matter is described in the context of being removable fixtures for an evaporator coil. The present disclosure, however, is not so limited, and can be applicable in other contexts such as air filtration systems, industrial process systems, or other contexts. Accordingly, when the present disclosure is described in the context of removable fixtures for an evaporator coil, it will be understood that other implementations can take the place of those referred to.

It should also be noted that, as used in the specification and the appended claims, the singular forms "a," "an," and "the" include plural references unless the context clearly dictates otherwise. References to a composition containing "a" constituent is intended to include other constituents in addition to the one named.

Also, in describing the disclosed technology, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, the disclosed technology can include from the one particular value and/or to the other particular value. Further, ranges described as being between a first value and a second value are inclusive of the first and second values. Likewise, ranges described as being from a first value and to a second value are inclusive of the first and second values.

It is also to be understood that the mention of one or more method steps does not preclude the presence of additional method steps or intervening method steps between those steps expressly identified. Moreover, although the term "step" can be used herein to connote different aspects of methods employed, the term should not be interpreted as implying any particular order among or between various steps herein disclosed unless and except when the order of individual steps is explicitly required. Further, the disclosed technology does not necessarily require all steps included in the methods and processes described herein. That is, the disclosed technology includes methods that omit one or more steps expressly discussed with respect to the methods described herein.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

As used herein, the terms "a", "an" and the like generally carry a meaning of "one or more," unless stated otherwise. Further, the terms "approximately", "approximate", "about", and similar terms generally refer to ranges that include the identified value within a margin of 20%, 10%, or preferably 5%, and any values therebetween.

The components described hereinafter as making up various elements of the disclosed technology are intended to be illustrative and not restrictive. Many suitable components that would perform the same or similar functions as the components described herein are intended to be embraced within the scope of the disclosed technology. Such other components not described herein can include, but are not limited to, similar components that are developed after development of the presently disclosed subject matter.

Referring to FIG. 1, a perspective view of an air handler 100 is illustrated. The air handler 100 includes a cabinet 102, a V-shaped round tube plate fin evaporator coil 104 (hereinafter referred to as "the coil 104") disposed within the cabinet 102, and a drain pan 106 detachably coupled to a base of the coil 104. The coil 104 includes a first arm 108, a second arm 110, a first tube sheet 112 mounted to the first arm 108, and a second tube sheet 114 mounted to the second arm 110. The coil 104 includes a distributor (not shown) to distribute fluid, such as a refrigerant, through the tubes thereof. According to an aspect of the present disclosure, the air handler 100 includes a first coil extension 116 removably coupled to the first tube sheet 112, and a second coil extension 118 removably coupled to the second tube sheet 114. Each of the first coil extension 116 and the second coil extension 118 extends along a transverse direction "T" of the coil 104. As used herein, the term "transverse direction" corresponds to a direction in which a width of the coil 104 is measured. Condensate formed on return bends 120 of refrigerant pipes drips on the first coil extension 116 and the second coil extension 118 and flows towards the drain pan 106.

Figure 2:
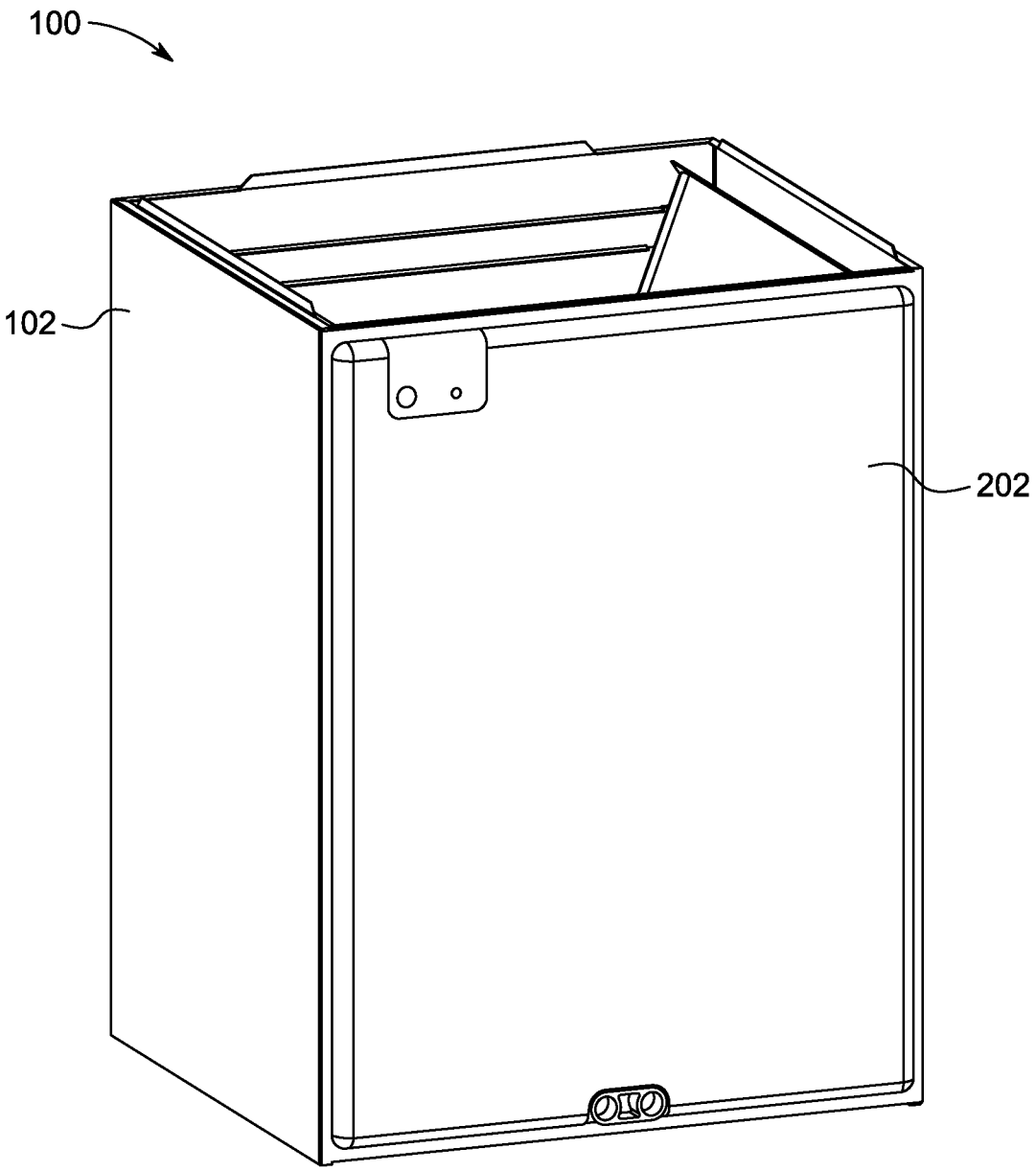
FIG. 2 is another perspective view of the air handler.

As shown in FIG. 2, the air handler 100 includes a door 202 disposed on a front portion of the cabinet 102 to provide access to the coil 104. In an embodiment, the door 202 is detachably coupled to the cabinet 102 via tooled fasteners (not shown). As used herein, the term "tooled fasteners" refers to fasteners which requires tools to disengage them from a structure. In a non-limiting example, the tooled fasteners may be one of screws or bolts.

Figure 3:
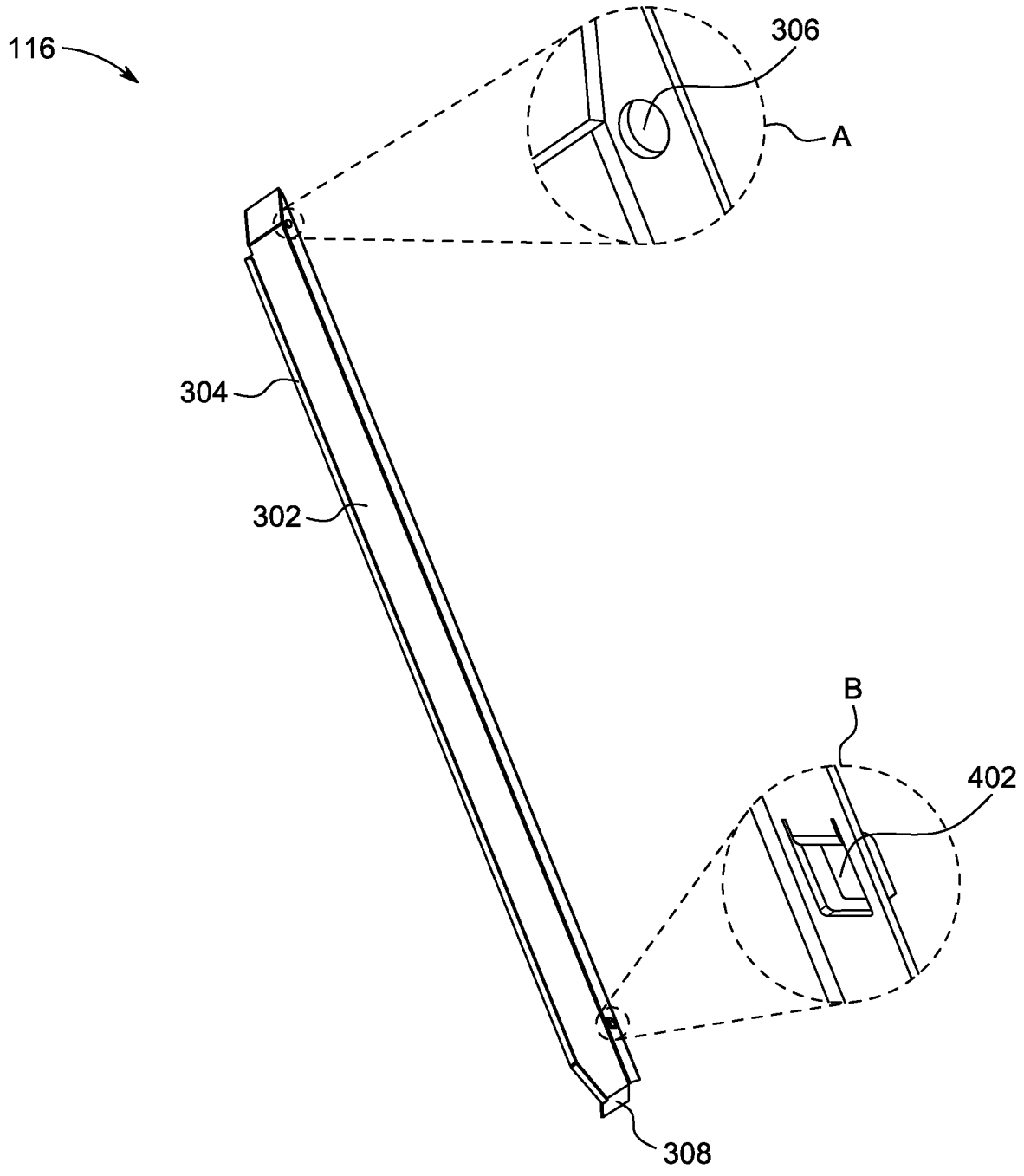
FIG. 3 is a perspective view of a first coil extension of a V-shaped round tube plate fin evaporator coil of the air handler, according to an embodiment of the present disclosure.

FIG. 3 illustrates a perspective view of the first coil extension 116. In an embodiment, each of the first coil extension 116 and the second coil extension 118 is made of one of aluminum, steel, or galvanized steel. In some embodiments, a length of each of the first coil extension 116 and the second coil extension 118 is in a range of about 18 inches to about 40 inches. In an embodiment, the first coil extension 116 includes a flat longitudinal surface 302 configured to direct the condensate towards the drain pan 106.

The first coil extension 116 includes a first peripheral surface 304 that is configured to face an inner surface of the door 202 when removably coupled to the first tube sheet 112. FIG. 3 also illustrates an enlarged view of a portion "A" and portion "B" of the first coil extension 116. In an embodiment, as seen in the enlarged view of portion "A", the first coil extension 116 defines a first locating hole 306 and, as seen in the enlarged view of portion "B", includes a first tab 402 (clearly illustrated in FIG. 4A). Further, the first coil extension 116 includes a root member 308 configured to engage with the drain pan 106. The root member 308 is inclined at a predefined angle with respect to the flat longitudinal surface 302. For the purpose of brevity, only the first coil extension 116 is described. The second coil extension 118 includes corresponding features described with respect to the first coil extension 116. In an embodiment, the second coil extension 118 defines a second locating hole and includes a second tab and a root member.

Figure 4A:
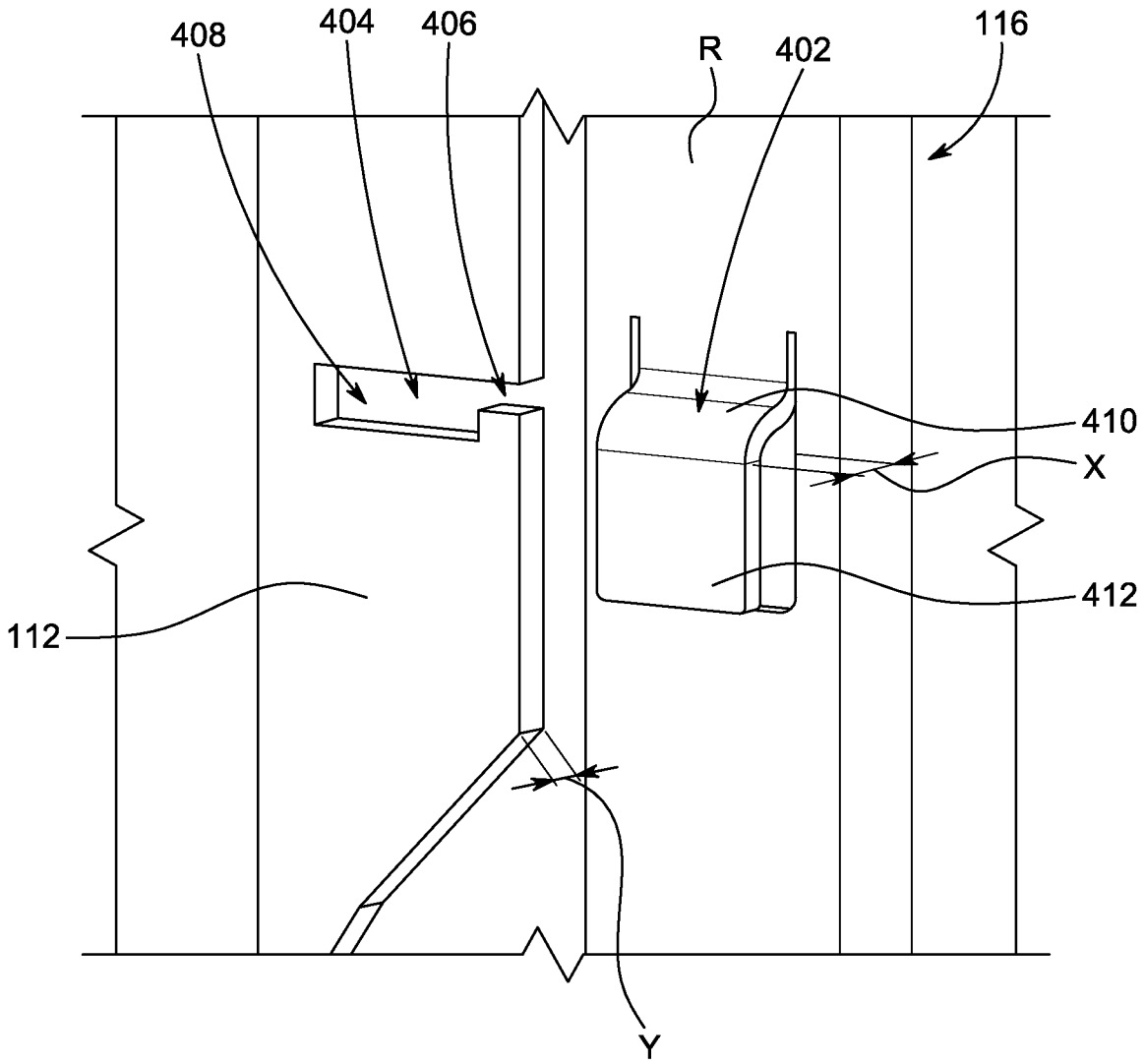
FIG. 4A illustrates a first assembly stage of assembling the V-shaped round tube plate fin evaporator coil, according to an aspect of the present disclosure.
Figure 4B:
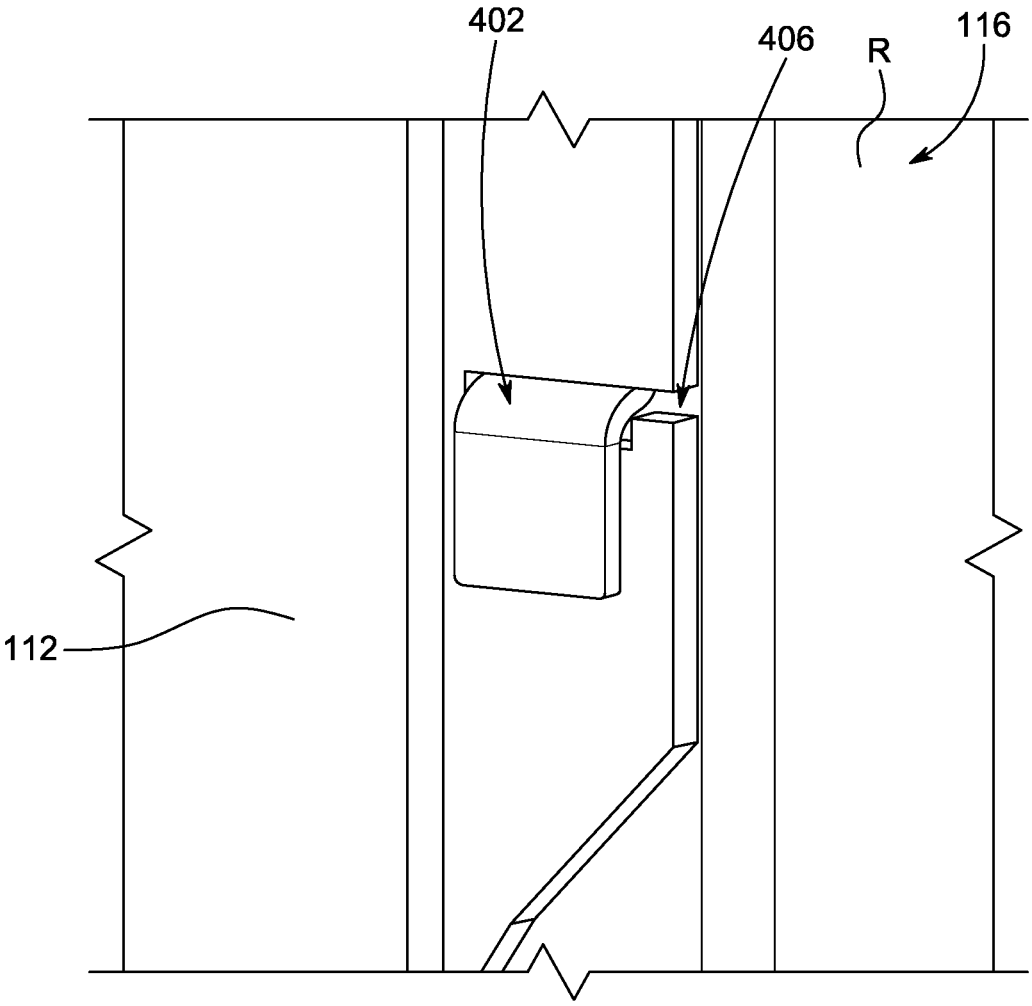
FIG. 4B illustrates a second assembly stage of assembling the V-shaped round tube plate fin evaporator coil, according to an aspect of the present disclosure.
Figure 4C:
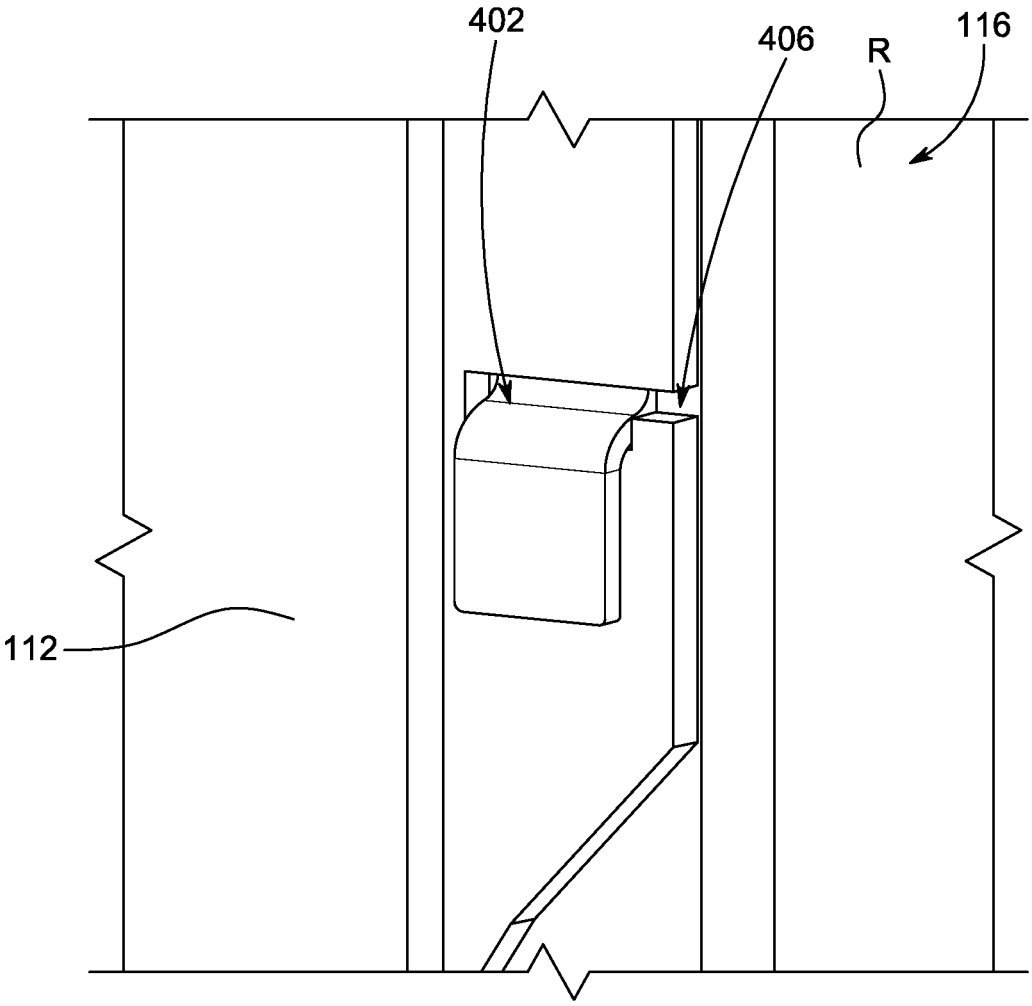
FIG. 4C illustrates a third assembly stage of assembling the V-shaped round tube plate fin evaporator coil, according to an aspect of the present disclosure.

FIGS. 4A, 4B and 4C illustrates a sequence of assembly stages of assembling the coil 104. Specifically, FIG. 4A illustrates a first assembly stage of assembling the coil 104, according to an aspect of the present disclosure. A rear surface "R" of the first coil extension 116 includes the first tab 402. In the illustrated embodiment, the first tab 402 is formed from a cut portion of the rear surface of the first coil extension 116. The surface opposite to the first peripheral surface 304, with respect to a width of the first coil extension 116, is referred to as "the rear surface". As such, the rear surface "R" of the first coil extension 116 remains distal from the inner surface of the door 202.

The first tube sheet 112 defines a first slit 404 extending along a width thereof as shown in FIG. 4A. The first slit 404 has a narrow portion 406 and a broad portion 408. According to an aspect, the first tab 402 is configured to engage with the first slit 404, to removably couple the first coil extension 116 with the first tube sheet 112. Particularly, the first slit 404 is configured to receive the first tab 402 therein. The first tab 402 includes an arcuate portion 410 and a planar portion 412. The arcuate portion of the first tab 402 positions the planar portion 412 at a distance "X" from the rear surface "R" of the first coil extension 116. The distance "X" is preset to be greater than a thickness "Y" of the first tube sheet 112. Additionally, a width of the narrow portion 406 of the first slit 404 is designed to be greater than a thickness of the first tab 402. In the first assembly stage, the arcuate portion 410 of the first tab 402 is aligned with the narrow portion 406 of the first slit 404.

FIG. 4B illustrates a second assembly stage of assembling the coil 104, according to an aspect of the present disclosure. In the second assembly stage, the first coil extension 116 is moved towards the first tube sheet 112, such that the arcuate portion 410 of the first tab 402 is received within the narrow portion 406 of the first slit 404. Further movement of the first coil extension 116 into the first slit 404 allows the first tab 402 to be completely received within the first slit 404, as shown in FIG. 4B.

FIG. 4C illustrates a third assembly stage of assembling the coil 104, according to an aspect of the present disclosure. The first coil extension 116 is moved in a direction along a length of the first tube sheet 112 to lock the first tab 402 within the broad portion 408 of the first slit 404. Such an arrangement prevents the first coil extension 116 from being detached through the narrow portion 406 of the first slit 404. Therefore, the first coil extension 116 is removably coupled to the first tube sheet 112. Following these steps in a reverse order allows detachment of the first coil extension 116 from the first tube sheet 112.

Figure 5A:
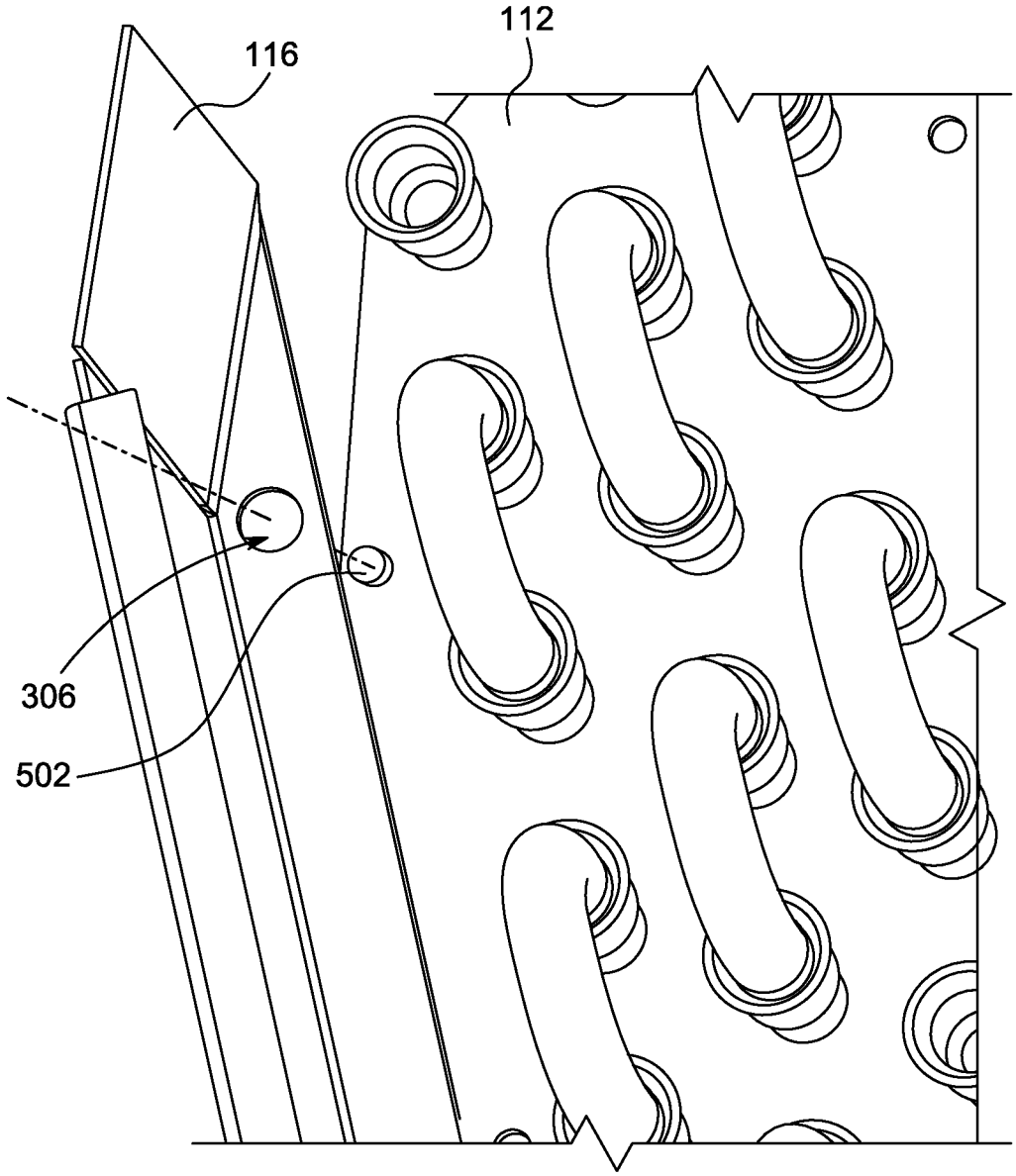
FIG. 5A illustrates a fourth assembly stage of assembling the V-shaped round tube plate fin evaporator coil, according to an aspect of the present disclosure.
Figure 5B:
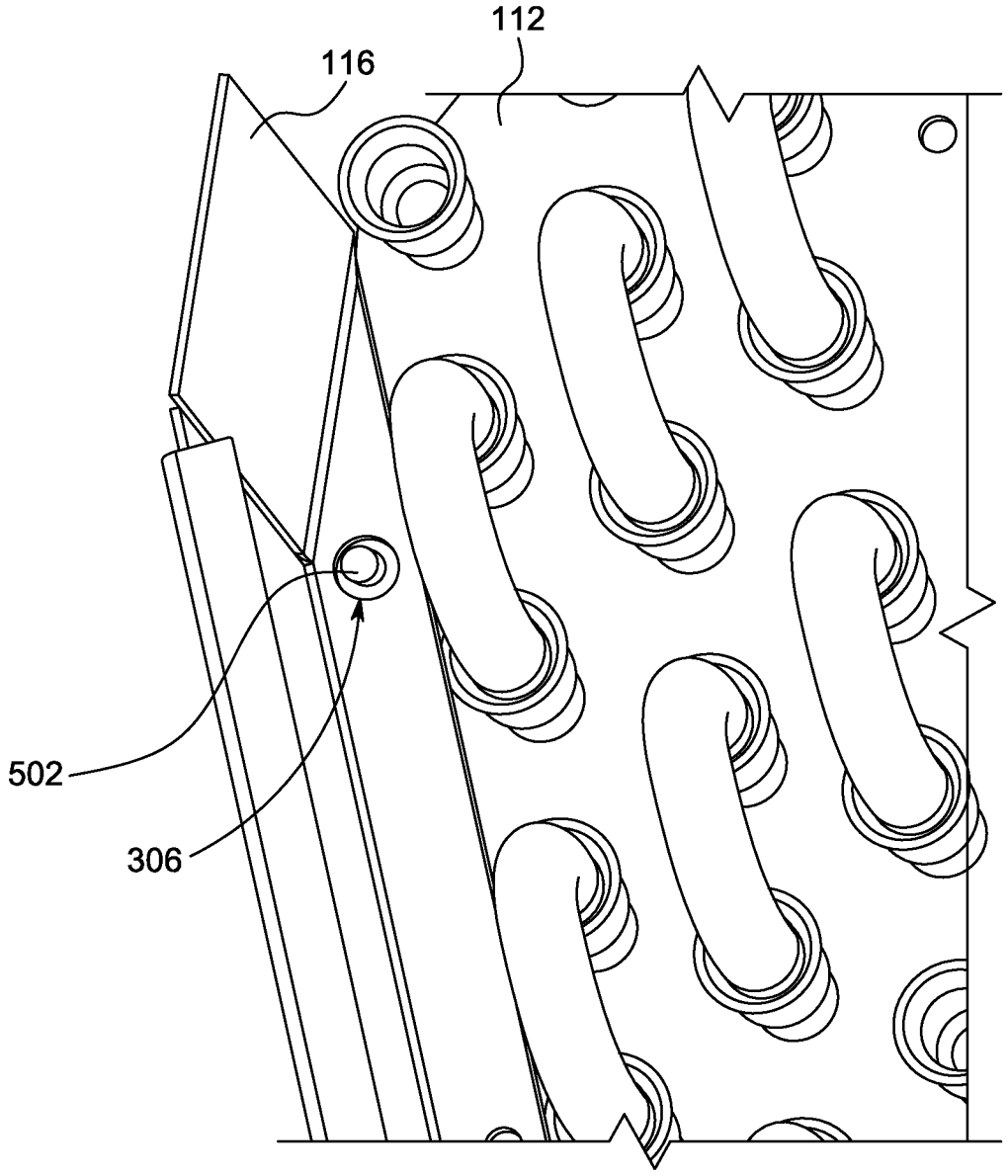
FIG. 5B illustrates a fifth assembly stage of assembling the V-shaped round tube plate fin evaporator coil, according to an aspect of the present disclosure.

FIG. 5A and FIG. 5B illustrates another set of sequential stages of assembling the coil 104. Specifically, FIG. 5A illustrates a fourth assembly stage and FIG. 5B illustrates a fifth assembly stage of assembling the coil 104, according to an aspect of the present disclosure. The first tube sheet 112 includes a first protrusion 502. The first locating hole 306 defined in the first coil extension 116 is aligned with the first protrusion 502. As shown in FIG. 5B, the first coil extension 116 is moved towards the first tube sheet 112 until the first protrusion 502 is received in the first locating hole 306. In some embodiments, the first locating hole 306 may get aligned with the first protrusion 502 simultaneously when the first tab 402 is locked within the first slit 404. In some embodiments, the assembly stages described with respect to FIG. 5A and FIG. 5B may be performed separately after the assembly stages described with respect to FIGS. 4A to 4C. In some embodiments, the first tube sheet 112 may define another hole instead of the first protrusion 502, to be aligned with the first locating hole 306 defined in the first coil extension 116. Once the two holes are aligned, a fastener may be used to couple the first coil extension 116 to the first tube sheet 112.

The terms "first assembly stage", "second assembly stage", "third assembly stage", "fourth assembly stage", and "fifth assembly stage" used herein are merely for the purpose of clarity in description and do not represent the initial steps in order of assembling the coil 104.

Although not illustrated through figures, as mentioned earlier, the second coil extension 118 and the second tube sheet 114 include features corresponding to those described with respect to the first coil extension 116 and the first tube sheet 112, respectively. In an embodiment, the second tube sheet 114 defines a second slit and the second coil extension 118 includes a second tab configured to engage with the second slit. Additionally, the second tube sheet 114 includes a second protrusion and the second coil extension 118 defines a second locating hole configured to receive the second protrusion. To this end, the first coil extension 116 and the second coil extension 118 may be removably coupled to the first tube sheet 112 and the second tube sheet 114, respectively. From the description herein, other methods of removably coupling the first coil extension 116 with the first tube sheet 112 and the second coil extension 118 with the second tube sheet 114 may be apparent to a person skilled in the art.

Figure 6:
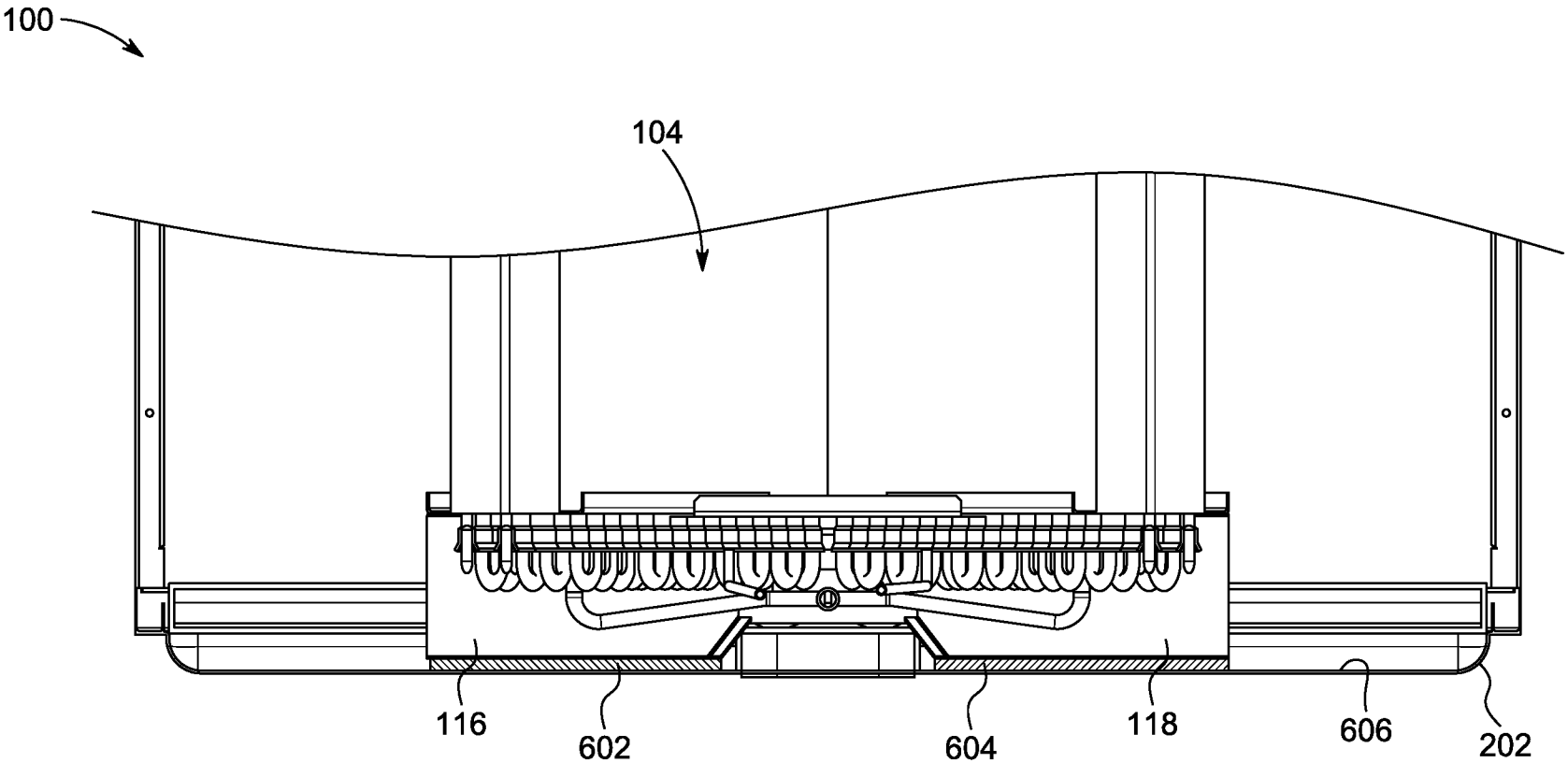
FIG. 6 illustrates a portion of a cross-sectional top view of the air handler, according to an embodiment of the present disclosure.

FIG. 6 illustrates a cross-sectional top view of the air handler 100. In an embodiment, the air handler 100 may include a first sealing member 602 attached to the first peripheral surface 304 of the first coil extension 116 and a second sealing member 604 attached to the second peripheral surface 120 (see FIG. 1) of the second coil extension 118. In an embodiment, each of the first sealing member 602 and the second sealing member 604 includes a compressive material. In some embodiments, the first sealing member 602 and the second sealing member 604 is one of compressible closed cell foam, silicone, latex rubber, butyl rubber, or a resin-based sealant. In some embodiments, a thickness of each of the first sealing member 602 and the second sealing member 604 is in a range of about 0.125 inch to about 0.75 inch. According to an aspect of the present disclosure, the first peripheral surface 304 of the of the first coil extension 116, the second peripheral surface 120 of the second coil extension 118, and the inner surface 606 of the door 202 are together configured to achieve an air-tight seal. Particularly, the first sealing member 602 attached to the first peripheral surface 304 of the first coil extension 116 and the second sealing member 604 attached to the second peripheral surface 120 of the second coil extension 118 aid in achieving the air-tight seal between the coil 104 and the door 202. In an embodiment, a rear portion of the coil 104 may include coil extensions similar to those described herein, and additional sealing members may be used to achieve an air-tight seal between such coil extensions and rear wall of the cabinet 102.

As such, a first air flow region 122 (see FIG. 1) that is in fluid communication with the first arm 108 of the coil 104 and a second air flow region 124 (see FIG. 1) that is in fluid communication with the second arm 110 of the coil 104 may be free from openings through which the air escapes from the flow regions. Therefore, in a draw-through application, it may be ensured that the suctioned air passes wholly through the arms 108, 110 of the coil 104. Typically, a temperature difference between the air flowing across the arms 108, 110 of the coil 104 and the condensate flowing along the coil extensions 116, 118 may result in formation of condensation droplets on a bottom surface of the coil extensions 116, 118. Accumulation of such droplets may cause dripping of the condensate from the coil 104.

In an embodiment, the air handler 100 may include a first insulation strip (not shown) attached to a bottom surface 126 (see FIG. 1) of the first coil extension 116 and a second insulation strip (not shown) attached to a bottom surface (not shown) of the second coil extension 118. Each of the first insulation strip and the second insulation strip is configured to prevent dripping of condensate from corresponding bottom surfaces of the first coil extension 116 and the second coil extension 118, respectively. In some embodiments, each of the first insulation strip and the second insulation strip includes foam. In some embodiments, a thickness of each of the first insulation strip and the second insulation strip is in a range of about $1/16^{th}$ inch to about $1/8^{th}$ inch. In some embodiments, each of the first insulation strip and the second insulation strip may include copper dispersed therein, so that copper ions are added to the condensate to kill viruses therein and prevent growth of bacteria.

Figure 7:
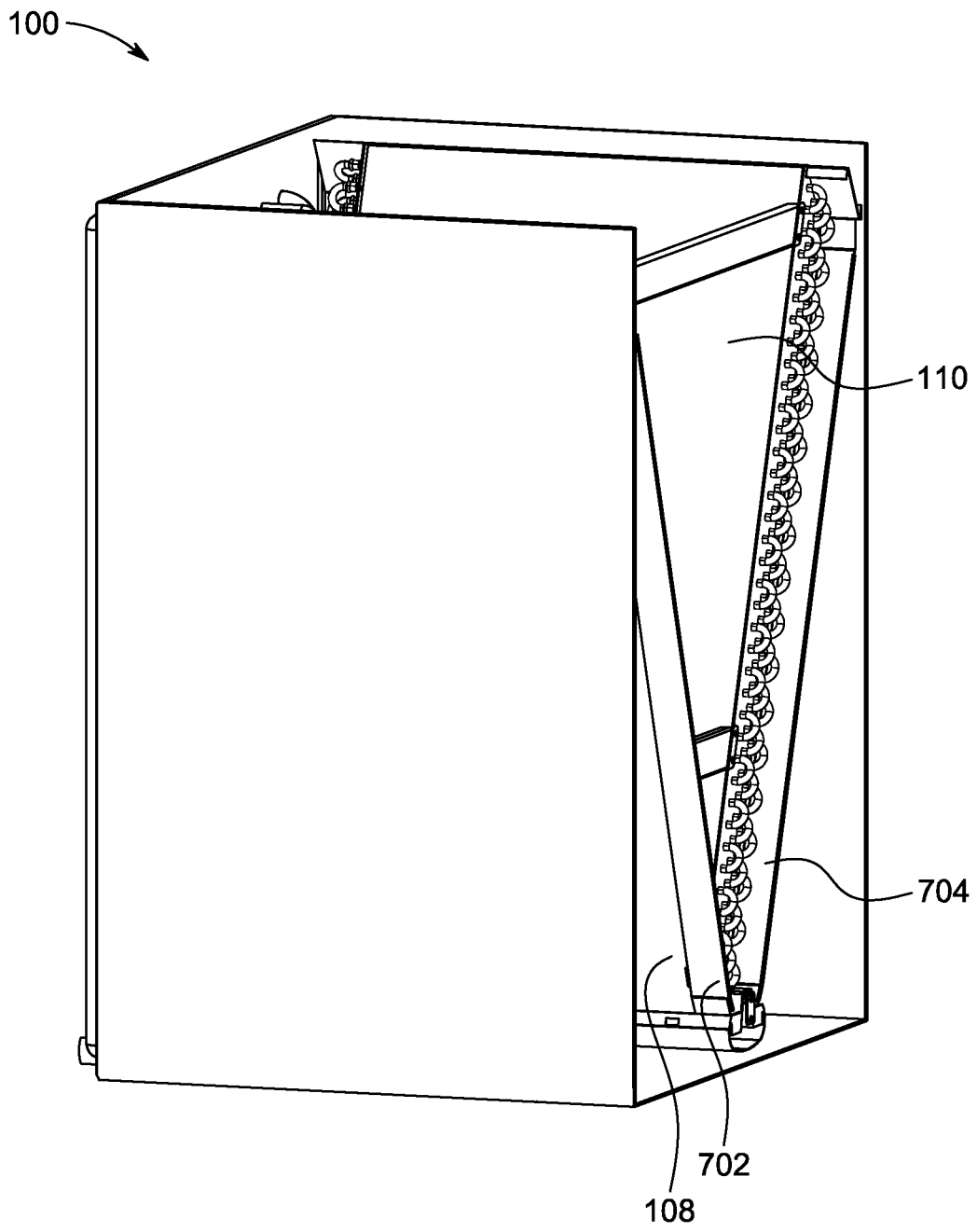
FIG. 7 illustrates a rear portion of the V-shaped round tube plate fin evaporator coil, according to an aspect of the present disclosure.

FIG. 7 illustrates a rear portion of the coil 104. In some embodiments, the coil 104 includes a third coil extension 702 removably coupled to a rear portion of the first arm 108 of the coil 104 and a fourth coil extension 704 removably coupled to a rear portion of the second arm 110 of the coil. Each of the third coil extension 702 and the fourth coil extension 704 extends along the transverse direction "T" of the coil 104. The third coil extension 702, the fourth coil extension 704, and a rear panel (not shown) of the cabinet are configured to together achieve an air-tight seal. Structurally, the third coil extension 702 and the fourth coil extension 704 include features already described with respect to the first coil extension 116 and the second coil extension 118. Additionally, a manner in which the third coil extension 702 and the fourth coil extension 704 are coupled to rear portions of the first arm 108 and the second arm 110, respectively, is the same described with respect to that of the first coil extension 116 and the second coil extension 118.

To this end, the present disclosure provides the air handler 100 that effectively drains the condensate and prevents bypass of air within the cabinet 102. Particularly, presence of the first sealing member 602 and the second sealing member 604 between the respective coil extensions 116, 118 and the inner surface 606 of the door 202 ensures the bypass of the air is prevented. As such, requirement of delta plates is overcome. Therefore, a service personnel may easily access an upstream portion of the coil 104 to perform the maintenance activity without the need to remove the coil 104 from the cabinet 102. Such provision reduces the overall time required to execute the maintenance of the coil 104 and reduces the overall cost and weight of the air handler due to absence of the delta plates. Additionally, presence of the tabs on the coil extensions and slits in the tube sheets eliminates need for tools, thereby easing the assembly process. The coil extensions may be embodied as sheet metal parts, and hence the tabs may be formed therein with minimum time and effort. Although the coil extensions herein are described with respect to the V-coil, in some embodiments, the coil extensions of the present disclosure may be used in A-coil, N-coil, and the like.

Figure 8A:
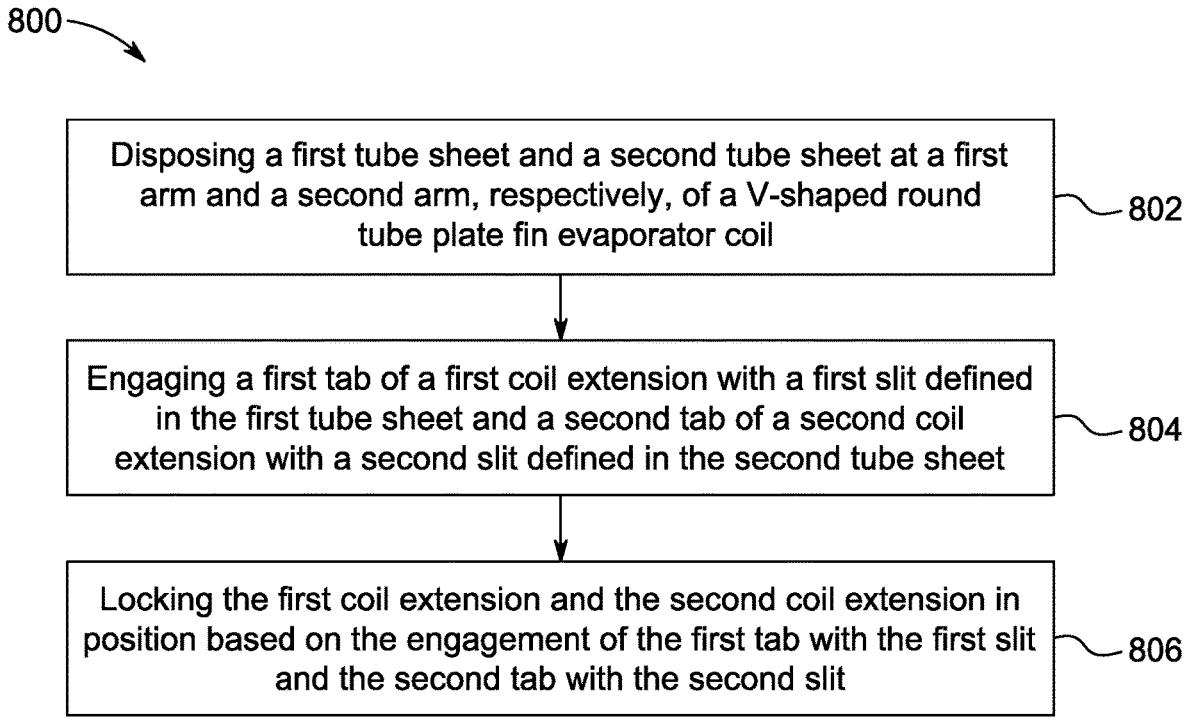
FIG. 8A is a flowchart of a method of assembling the V-shaped round tube plate fin evaporator coil, according to an aspect of the present disclosure.

FIG. 8A illustrates a flowchart of a method 800 and FIG. 7B illustrates a flowchart of method 850 of assembling the coil 104, according to aspects of the present disclosure. The method 800 is described in conjunction with FIG. 1 through FIG. 6. The order in which the methods 800 and 850 are described is not intended to be construed as a limitation, and any number of the described method blocks can be combined in any order to implement the methods 800 and 850, or an alternative method. Additionally, individual blocks may be deleted from the methods 800 and 850 without departing from the scope of the subject matter described herein.

At step 802, the method 800 includes disposing the first tube sheet 112 at the first arm 108 of the coil 104 and the second tube sheet 114 at the second arm 110 of the coil 104.

At step 804, the method 800 includes engaging the first tab 402 of the first coil extension 116 with the first slit 404 defined in the first tube sheet 112 and the second tab of the second coil extension 118 with the second slit defined in the second tube sheet 114.

At step 806, the method 800 includes locking the first coil extension 116 and the second coil extension 118 in position based on the engagement of the first tab 402 with the first slit 404 and the second tab with the second slit.

Figure 8B:
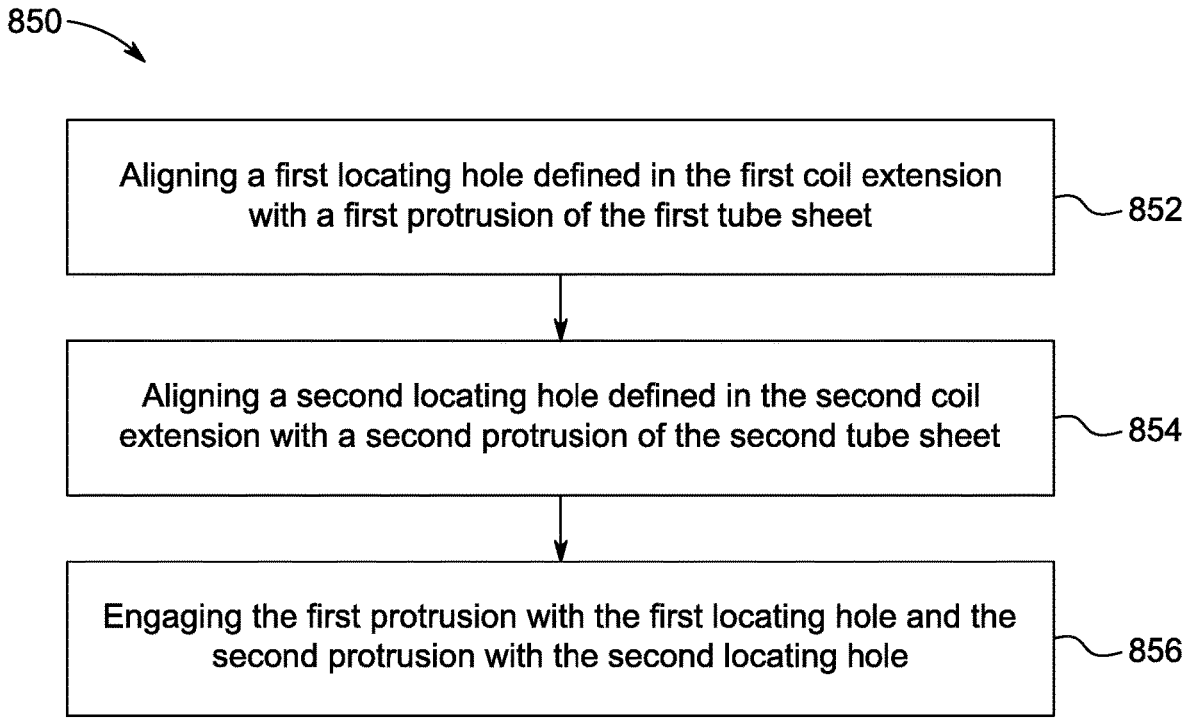
FIG. 8B is a flowchart of a method of assembling the V-shaped round tube plate fin evaporator coil, according to another aspect of the present disclosure.

Referring to FIG. 8B, at step 852, the method 850 includes aligning the first locating hole 306 defined in the first coil extension 116 with the first protrusion 502 of the first tube sheet 112.

At step 854, the method 850 includes aligning the second locating hole defined in the second coil extension 118 with the second protrusion of the second tube sheet 114.

At step 856, the method 850 includes engaging the first protrusion 502 with the first locating hole 306 and the second protrusion with the second locating hole.

Although not particularly illustrated through method blocks, in some embodiments, each of the method 800 and 850 may include attaching the first sealing member 602 to the first peripheral surface 304 of the first coil extension 116 and the second sealing member 604 to the second peripheral surface 120 of the second coil extension 118.

While aspects of the present disclosure have been particularly shown and described with reference to the embodiments above, it will be understood by those skilled in the art that various additional embodiments may be contemplated by the modification of the disclosed methods without departing from the spirit and scope of what is disclosed. Such embodiments should be understood to fall within the scope of the present disclosure as determined based upon the claims and any equivalents thereof.

What is claimed is:

1. An air handler comprising:

a cabinet;

a V-shaped round tube plate fin evaporator coil disposed within the cabinet;

a first coil extension coupled to a first tube sheet at a first arm of the V-shaped round tube plate fin evaporator coil, wherein the first coil extension extends along a transverse direction of the V-shaped round tube plate fin evaporator coil;

a second coil extension coupled to a second tube sheet at a second arm of the V-shaped round tube plate fin evaporator coil, wherein the second coil extension extends along the transverse direction of the V-shaped round tube plate fin evaporator coil; and a door disposed on a front portion of the cabinet to provide access to the V-shaped round tube plate fin evaporator coil, wherein the first coil extension, the second coil extension, and the door are together configured to achieve an air-tight seal.

2. The air handler of claim 1, wherein the first coil extension is removably coupled to the first tube sheet and the second coil extension is removably coupled to the second tube sheet.

3. The air handler of claim 1, wherein the door is detachably coupled to the cabinet via tooled fasteners.

4. The air handler of claim 1, wherein each of the first coil extension and the second coil extension comprises a flat longitudinal surface configured to direct condensate towards a drain pan of the V-shaped round tube plate fin evaporator coil.

5. The air handler of claim 1, wherein:

the first tube sheet defines a first slit, the second tube sheet defines a second slit, the first coil extension comprises a first tab configured to engage with the first slit, and the second coil extension comprises a second tab configured to engage with the second slit.

6. The air handler of claim 1, wherein:

the first tube sheet includes a first protrusion, the second tube sheet includes a second protrusion, the first coil extension defines a first locating hole configured to receive the first protrusion, and the second coil extension defines a second locating hole configured to receive the second protrusion.

7. The air handler of claim 1, wherein each of the first coil extension and the second coil extension comprises a root member configured to engage with a drain pan of the V-shaped round tube plate fin evaporator coil.

8. The air handler of claim 1, wherein each of the first coil extension and the second coil extension is made of one of aluminum, steel, or galvanized steel.

9. The air handler of claim 1, wherein a length of each of the first coil extension and the second coil extension is in a range of about 18 inches to about 40 inches.

10. The air handler of claim 1 further comprising:

a third coil extension coupled to a rear portion of a first arm of the V-shaped round tube plate fin evaporator coil, wherein the third coil extension extends along a transverse direction of the V-shaped round tube plate fin evaporator coil; and a fourth coil extension coupled to a rear portion of a second arm of the V-shaped round tube plate fin evaporator coil, wherein the fourth coil extension extends along the transverse direction of the V-shaped round tube plate fin evaporator coil, and wherein the third coil extension, the fourth coil extension, and a rear panel of the cabinet are together configured to achieve an air-tight seal.

11. The air handler of claim 1 further comprising:

a first sealing member attached to a first peripheral surface of the first coil extension, and a second sealing member attached to a second peripheral surface of the second coil extension, wherein the first sealing member and the second sealing member are configured to achieve the air-tight seal with an inner surface of the door.

12. The air handler of claim 11, wherein each of the first sealing member and the second sealing member comprises a compressive material.

13. The air handler of claim 11, wherein each of the first sealing member and the second sealing member is one of compressible closed cell foam, silicone, latex rubber, butyl rubber, or a resin-based sealant.

14. The air handler of claim 11, wherein a thickness of each of the first sealing member and the second sealing member is in a range of about 0.125 inch to about 0.75 inch.

15. The air handler of claim 1 further comprising:

a first insulation strip attached to a bottom surface of the first coil extension; and a second insulation strip attached to a bottom surface of the second coil extension, wherein each of the first insulation strip and the second insulation strip is configured to prevent dripping of condensate from corresponding bottom surfaces of the first coil extension and the second coil extension, respectively.

16. The air handler of claim 15, wherein each of the first insulation strip and the second insulation strip comprises foam.

17. The air handler of claim 15, wherein a thickness of each of the first insulation strip and the second insulation strip is in a range of about $1/16^{th}$ inch to about $1/8^{th}$ inch.

* * * * *